US012774827B2

(12) United States Patent
Barbarin et al.

(10) Patent No.: US 12,774,827 B2
(45) Date of Patent: Oct. 27, 2026

(54) DAMPER FOR REGULATING AN AIR FLOW AND VENTILATION INSTALLATION COMPRISING SUCH A DAMPER

(71) Applicant: ANJOS VENTILATION, Torcieu (FR)

(72) Inventors: Christian Gilles Barbarin, Amberieu en Bugey (FR); Laurent Hervé Barbarin, Amberieu en Bugey (FR)

(73) Assignee: ANJOS VENTILATION, Torcieu (FR)

( * ) Notice: Subject to any disclaimer, the term of this patent is extended or adjusted under 35 U.S.C. 154(b) by 548 days.

(21) Appl. No.: 18/262,575

(22) PCT Filed: Feb. 2, 2022

(86) PCT No.: PCT/EP2022/052483
§ 371 (c)(1),
(2) Date: Jul. 23, 2023

(87) PCT Pub. No.: WO2022/167484
PCT Pub. Date: Aug. 11, 2022

(65) Prior Publication Data

US 2024/0077226 A1 Mar. 7, 2024

(30) Foreign Application Priority Data

Feb. 3, 2021 (FR) ..... 2101034

(51) Int. Cl.
*F24F 11/75* (2018.01)
*F24F 13/14* (2006.01)

(52) U.S. Cl.
CPC ..... *F24F 11/75* (2018.01); *F24F 13/1426* (2013.01); *F24F 2013/146* (2013.01); *F24F 2013/1473* (2013.01)

(58) Field of Classification Search
USPC ..... 454/229–233, 254–338
See application file for complete search history.

(56) References Cited

U.S. PATENT DOCUMENTS 5,766,069 A * 6/1998 Baek ..... B60H 1/345 454/153
7,582,009 B1 9/2009 Cote
2009/0029642 A1* 1/2009 Martel ..... F24F 13/0236 454/358

FOREIGN PATENT DOCUMENTS

DE 20207946 U1 8/2002
DE 202004003811 U1 11/2004
(Continued)

OTHER PUBLICATIONS

FR 2101034, INPI Rapport de Recherche Preliminaire, Oct. 19, 2021, 2 pages.

(Continued)

*Primary Examiner* — Ko-Wei Lin
(74) *Attorney, Agent, or Firm* — Soquel Group LLC

(57) ABSTRACT

Control damper including a body, defining a duct with an axis of blowing, and a control device, including a flap for closing the duct, the flap being movable in rotation with respect to the body about a pivot axis orthogonal to the axis of blowing, means for adjusting a nominal position of the flap, and a return device returning the flap to the nominal position when the flap is moved away from the nominal position. For an improved control, the means for adjusting further includes a shaft pivotally mounted with respect to the body about an axis of adjustment, wherein an angular position of the shaft about the axis of adjustment is adjustable, and at least one control cam limiting movements of the flap between the nominal position and an open position, wherein the return device includes a spring that is tensioned when the flap is in the nominal position.

11 Claims, 9 Drawing Sheets

(56) References Cited

FOREIGN PATENT DOCUMENTS

| | | | |
|---|---|---|---|
| EP | 1840477 | A2 | 10/2007 |
| FR | 2530774 | A1 | 1/1984 |

OTHER PUBLICATIONS

International Search Report, PCT/EP2022/052483, Apr. 21, 2022, 2 pages.

* cited by examiner

DAMPER FOR REGULATING AN AIR FLOW AND VENTILATION INSTALLATION COMPRISING SUCH A DAMPER

CROSS-REFERENCE TO RELATED APPLICATIONS

This application claims benefit under 35 USC § 371 of PCT Application No. PCT/EP2022/052483 entitled DAMPER FOR CONTROLLING AN AIR FLOW AND VENTILATION FACILITY COMPRISING SUCH A DAMPER, filed on Feb. 2, 2022 by inventors Christian Gilles Barbarin and Laurent Herve Barbarin. PCT Application No. PCT/EP2022/052483 claims priority of French Patent Application No. 21 01034, filed on Feb. 3, 2021.

FIELD OF THE INVENTION

The present invention relates to a damper for regulating an air flow and to a ventilation installation comprising such a damper.

BACKGROUND OF THE INVENTION

A ventilation installation generally comprises a drive unit, such as a fan, which draws air from at least one suction port, blows said air into one or a plurality of ventilation ducts and expels the air from each duct via at least one blowing port.

For each duct, the air flow depends in particular on the air pressure and the cross-section of the duct. In order to control the flow-rate of an air flow circulating in a duct, it is known how to install, in such duct, a control damper with a pivot flap. A nominal angular position of the flap is defined by a user, for closing, at a variable extent, the duct, and thus regulating the flow-rate of the air flow at a nominal flow-rate value.

On the other hand, the air pressure in said duct can vary e.g. under the effect of fouling of filters when the ventilation installation comprises filters, under the effect of a variation of the electrical voltage supplying the drive unit, etc. In order to maintain a substantially constant air flow over a wide range of pressures, it is known how to use a so-called "automatic balancing" damper, the flap of which automatically closes the duct when the air pressure increases, the flap returning to the nominal position thereof when the pressure decreases.

DE-202004003811-U1 describes e.g. such an automatic balancing damper. The automatic balancing damper comprises a pivot flap, which abuts against an orientable support, a nominal angular position of which is controlled by the user. Such damper further comprises a bellows, which tends to move the flap away from the support when the pressure increases, and a spring leaf, which tends to bring the flap back into abutment against the support. The bellows is relatively fragile and causes a delay in the control of the flow-rate when the pressure varies. The bellows is not suitable for sudden variations of pressure and the leaf spring has no return force when the flap is in the nominal position.

SUMMARY OF THE DESCRIPTION

Such are the problems the invention more particularly seeks to overcome, by proposing an improved control damper, the controlled flow-rate of which remains more stable over wide intervals of flow-rates and pressures.

To this end, the invention relates to a damper for regulating an air flow for a ventilation duct, comprising:

- a cylindrical body extending along an axis of blowing, delimiting an air duct,
- an adjustment device, comprising:
  - a flap for closing the duct, the flap being received in the duct and movable in rotation with respect to the body about a pivot axis orthogonal to the axis of blowing, between an open position, wherein the blocking of the duct is minimal, and a closed position, wherein the blocking of the duct is maximum,
  - means of adjustment configured for adjusting a nominal position of the flap, the nominal position being intermediate between the open position and the closed position, the flap in the nominal position defining a nominal angle with a median plane of the damper, the median plane being parallel to the axis of blowing and to the pivot axis,
- a return device, configured for returning the flap to the nominal position thereof when, under the effect of the airflow, the flap is moved away from the nominal position.

According to the invention, the control device further comprises:

- a shaft which extends along an axis of adjustment and is pivotally mounted with respect to the body about the axis of adjustment, the axis of adjustment being parallel to the pivot axis, an angular position of the shaft about the axis of adjustment being adjustable, and
- at least one adjustment cam, each adjustment cam protruding radially from the shaft and cooperating with a respective first stop of the flap, so as to limit the movements of the flap between the nominal position thereof and the open position thereof when the user defines the angular position of the shaft, whereas the return device comprises a tension spring with a first end and an opposite second end, where the first end is connected to an attachment point on the shaft, and the second end is connected to an attachment point provided on the flap, so that the spring is tensioned when the flap is in the nominal position.

By means of the invention, irrespective of the nominal position of the flap, as defined by the user, the flap is returned to the nominal position thereof by the return spring. The spring is robust and easy to adjust. The damper of the invention is thus particularly long-lasting and effective, the flow-rate being more stable over the entire pressure space. Since the spring is tensioned when the flap is in the nominal position, the control is more stable even when a pressure of the air flow in the duct is minimal. Furthermore, the spring tension is independent of the air flow pressure, which improves the stability of the damper control.

According to advantageous but non-mandatory aspects of the invention, such a damper can incorporate one or a plurality of the following features, taken individually or according to any technically permissible combination:

- The point of attachment is offset from the axis of adjustment, so that as the nominal angle increases, a length of the spring, and hence the moment of return of the flap to the nominal position thereof with respect to the pivot axis, decrease.
- The hard point and the attachment point are carried by a longitudinal plane of the body, the longitudinal plane being orthogonal to the pivot axis and bearing the axis of blowing.
- The adjustment device comprises at least two adjustment cams provided symmetrically on both sides of the longitudinal plane.

The adjustment device comprises a slide, while the flap and the shaft are each assembled onto the spool and movable in rotation with respect to the spool, the spool being received in the duct and attached to the body, the angular position of the shaft being controlled from outside the duct by means of a control member, e.g. a handwheel.

The control damper further comprises a damping member configured for damping the movements of the flap when the flap moves between the nominal position thereof and the control position thereof under the effect of variations in the air flow and of the return device.

The damping member has two opposite ends, which are connected to a flange of the flap and to an anchoring point, respectively, of the slide and which are aligned along a damping axis, the damping member being configured for generating a damping force along the damping axis, whereas the anchoring point is provided in a recess of the slide, so that the axis of damping does not intersect the pivot axis of the flap, regardless of the position of the flap.

The damping member is a gas shock absorber.

The shaft further comprises at least one control cam, each control cam protruding radially from the shaft, whereas the flap comprises at least a second stop, each second stop cooperating with a respective control cam so as to prevent the movements of the flap between the closed position and a control position intermediate between the nominal position and the closed position of the flap.

According to another aspect, the invention further relates to a ventilation installation, comprising a ventilation duct and a drive unit, the duct being configured for guiding the air flow displaced by the action of the drive unit, the ventilation installation comprising a control damper installed in the duct for regulating the flow-rate of the air flow, the damper being as described hereinabove.

BRIEF DESCRIPTION OF THE DRAWINGS

The invention will be better understood, and other advantages of the invention will appear more clearly in the light of the following description of two embodiments of a control damper and of a ventilation installation according to the principle thereof, given only as an example and made with reference to the enclosed drawings, wherein.

DETAILED DESCRIPTION OF EMBODIMENTS

Figure 1:
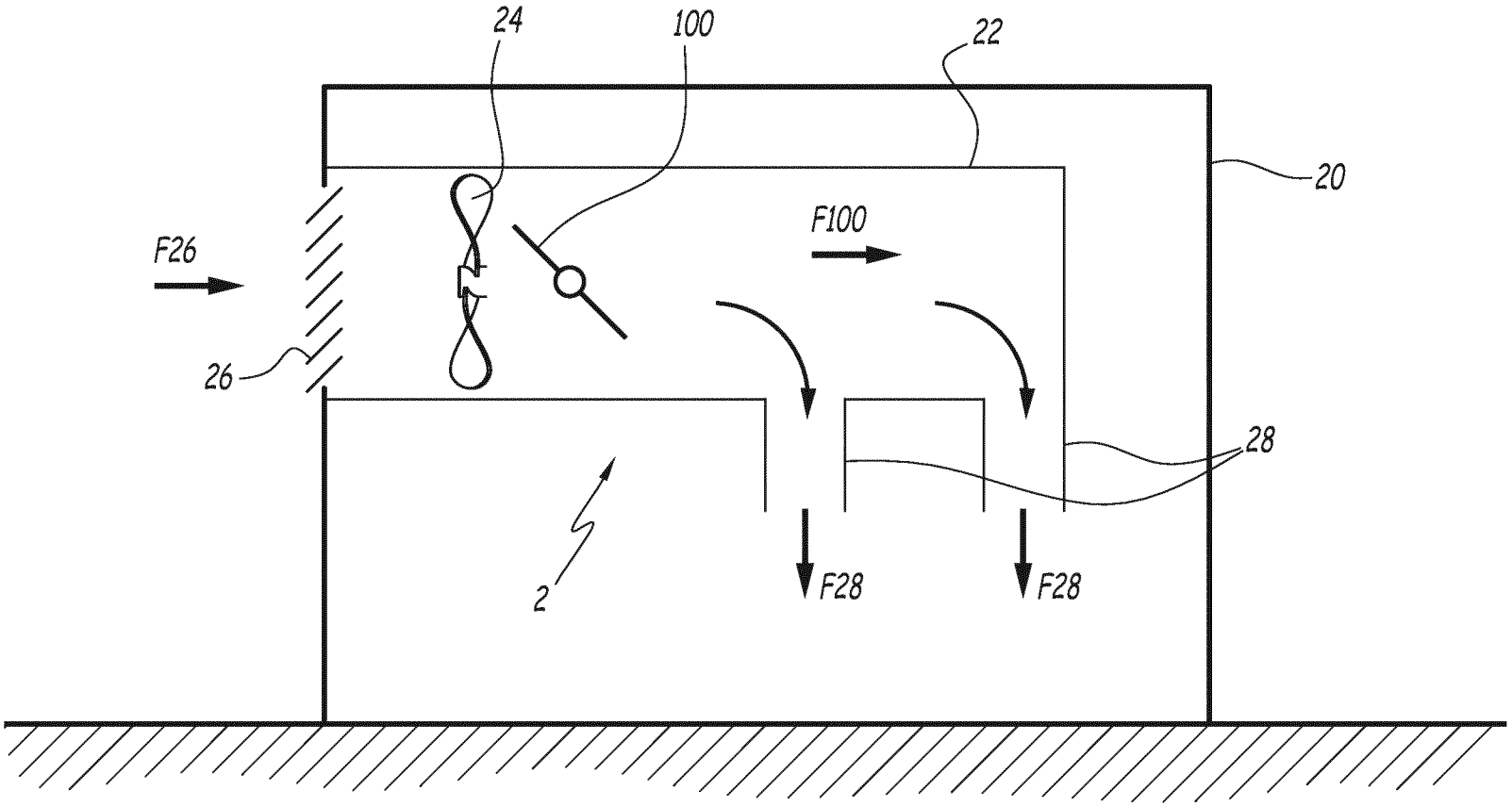
FIG. 1 is a schematic representation of a ventilation installation according to the invention, comprising a control damper according to the invention.
Figure 2:
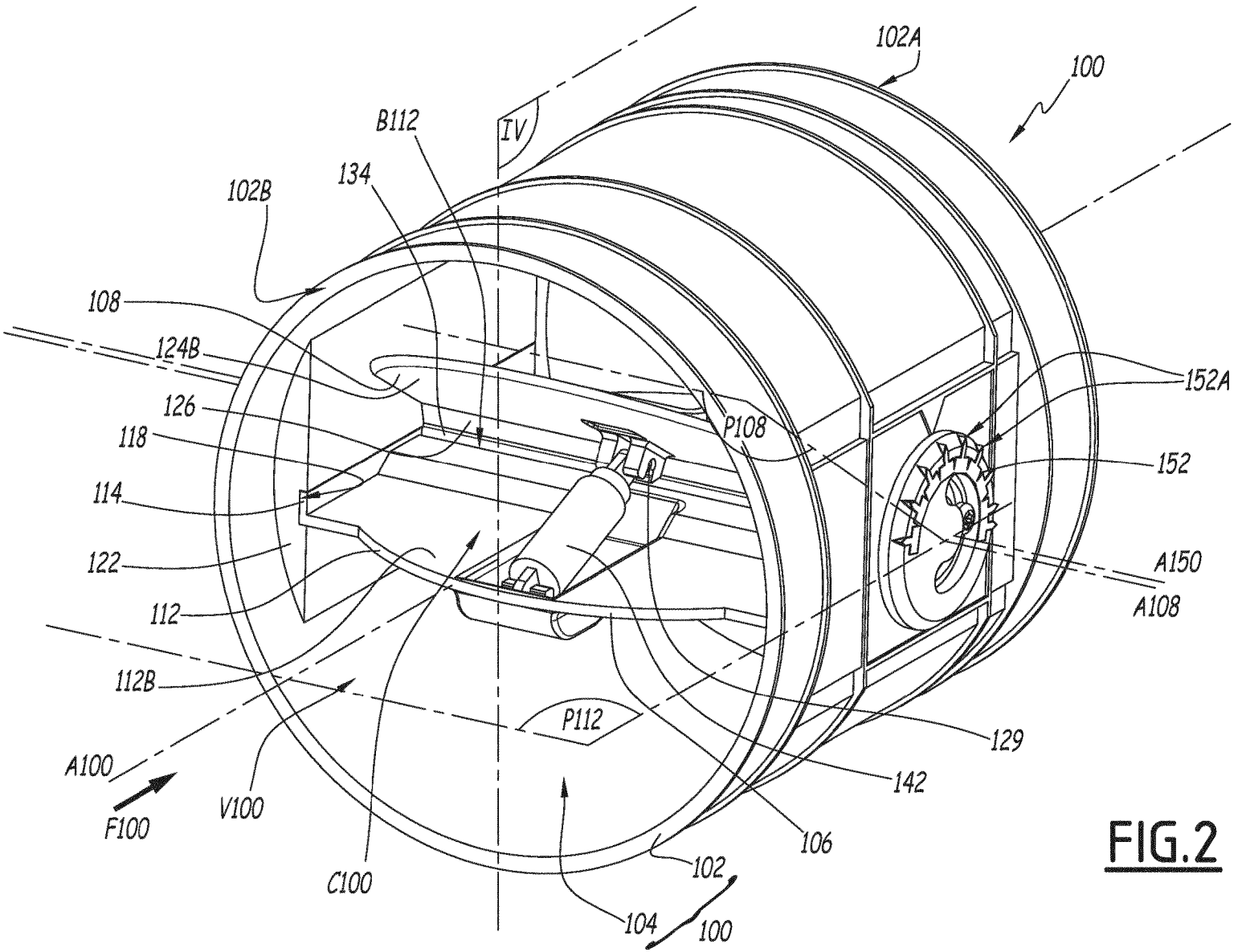
FIG. 2 is a perspective view of the control damper of the installation of FIG. 1, shown in a first configuration.

A ventilation installation 2 is schematically shown in FIG. 1. Herein, the ventilation installation 2 is situated inside a building 20 and is hence an indoor installation. In a variant, the ventilation installation 2 is situated outside the building 20, e.g. on the roof of the building 20, or even comprises indoor and outdoor portions.

The ventilation installation 2 comprises a ventilation duct 22 and a drive unit 24. The duct 22 connects an inlet port 26 to two outlet ports 28, whereas the drive unit 24, which is herein a fan received in the duct 22, is situated on an intermediate portion of the duct 22 between the inlet port 26 and the outlet ports 26. The number of inlet ports 26 and outlet ports 28 is not limiting, each ventilation installation 2 comprising at least one inlet port 26 and at least one outlet 28. The duct 22 is configured for guiding an air flow F100 displaced under the action of the drive unit 24. The drive unit 24 is configured for sucking in an air flow F26 from the inlet port 26, and for discharging an outlet air flow F28 via the outlet ports 28. The ventilation installation 2 is thus herein a blowing installation, which blows the air taken from outside into the building 20. In a variant, the ventilation installation 2 is an extraction installation, which discharges outside of the building 20 the air taken from the inside.

The ventilation installation 2 further comprises a control damper 100 installed in the duct 22. In the example illustrated, the damper 100 is situated downstream of the drive unit 24 along the direction of the air flow F100 in the duct 22, however other configurations are possible. For example, in the case of an extraction ventilation installation 2, the damper 100 is generally situated upstream of the drive unit 24.

Under the action of a user, the damper 100 is configured for blocking to a variable extent, the duct 22, so as to control the flow-rate of the air flow F100 flowing through the duct 22 at a level called a "nominal flow-rate". The nominal flow-rate thus corresponds to the flow-rate level desired by the user, the nominal flow-rate being variable depending on the choices of the user. The user is e.g. an installer of the ventilation installation 2, who adjusts the nominal flow-rate in each duct 22 during the commissioning of the ventilation installation 2. In a variant (not shown), a damper 100 is installed between the duct 22 and each of the outlet ports 28. Thereby, the user can adjust the flow-rate of the air flow passing through each of the outlet ports 28.

The damper 100 is an automatic balancing damper, i.e. once the user chooses a nominal flow-rate, the damper 100 is configured for adapting to variations in air pressure within the duct 22, so as to maintain the air flow-rate substantially at the nominal flow-rate. Schematically, when the air pressure increases, the damper 100 blocks the duct 22 more and more, whereas when the air pressure decreases, the damper 100 returns to a nominal configuration.

The structure of the damper 100 will now be described in detail with reference to FIGS. 2 to 6.

The user interface 100 comprises body 102 and an adjustment device 104. The body 102 has a cylindrical shape, herein with an overall circular cross-section, which extends along an axis of blowing A100 and which delimits a duct V100. For the sake of simplification, the turbulence phenomena are herein neglected and it is assumed that, schematically, in the duct V100, the air flow F100 is laminar and parallel to the axis of blowing A100.

The duct 22 is preferentially modular, i.e. the duct 22 comprises a plurality of elements assembled together, e.g. rectilinear tubes, elbows, etc. The body 102 is configured for being connected to the modular elements in a leak-tight way, e.g. by means of specific connectors and/or sealing elements. The modular elements and the fittings or the sealing elements are not shown. In the example, the body 102 is configured to be fitted, in a leak-tight way, into the duct elements 22 with a 125 mm diameter. The cross-section of the body 102 is adapted accordingly.

The damper 100 has a preferred mounting direction, i.e. the air flow F100 is preferentially always oriented along the same direction with respect to the damper 100. Thereby, the body 102 has a downstream side 102A and an upstream side 102B. The damper 100 is assembled onto the duct 22 in such a way that, preferentially, the axis of blowing A100 is horizontal, as shown in the figures. A longitudinal plane P100 of the damper 100 is defined as being a vertical plane parallel to the axis of blowing A100.

Figure 3:
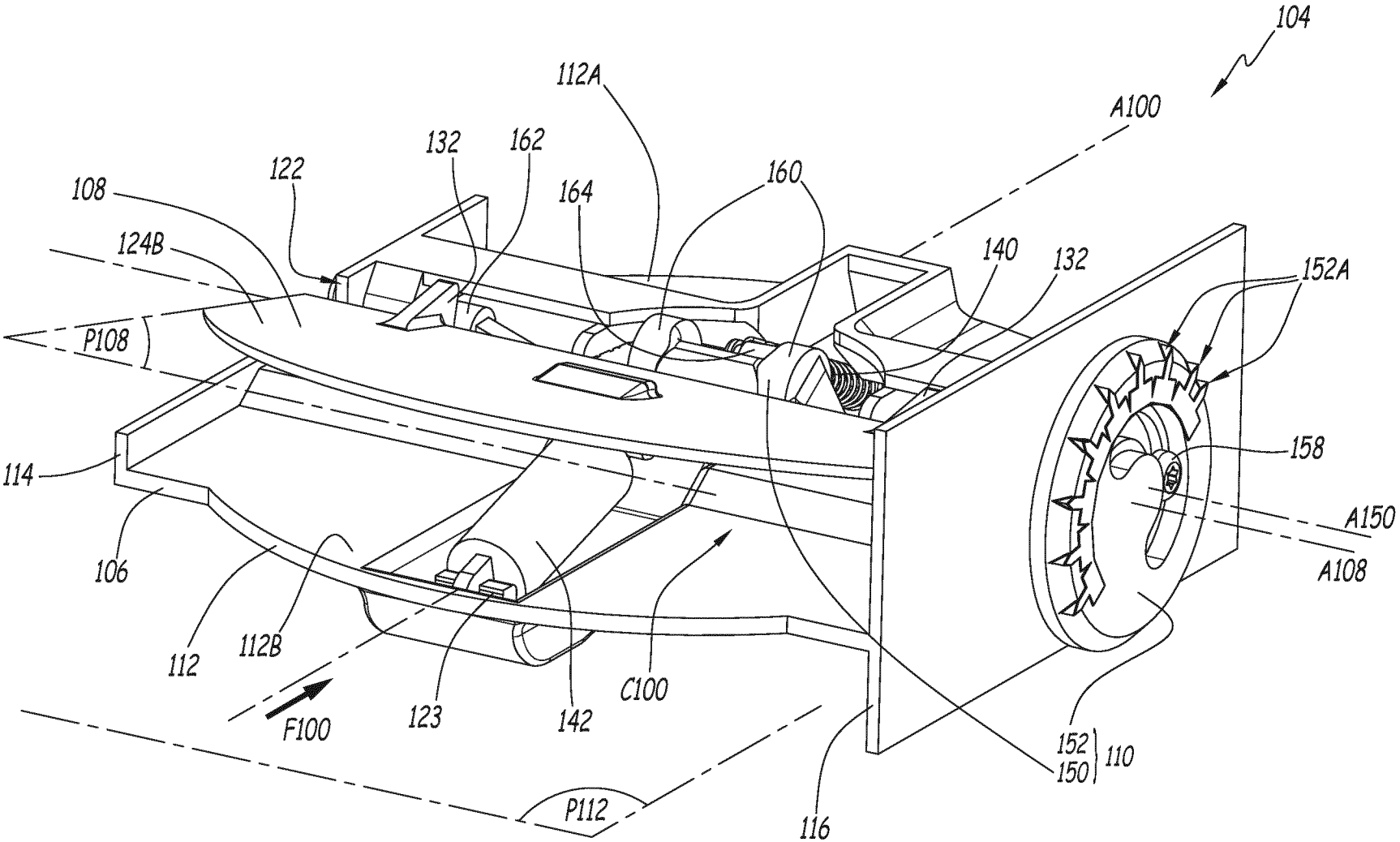
FIG. 3 is a perspective view of the control damper of FIG. 1, shown in a second configuration, where some elements were omitted.
Figure 4:
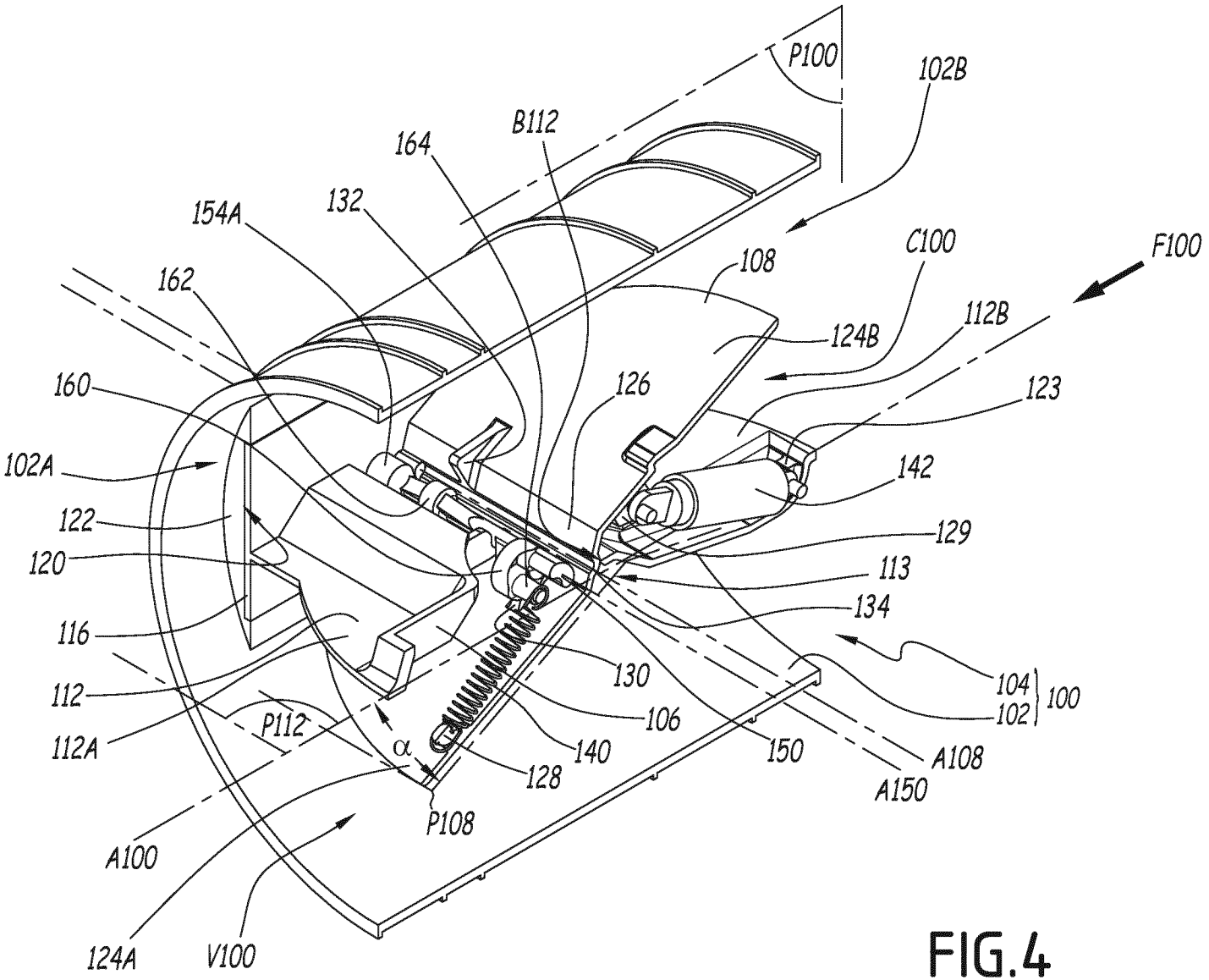
FIG. 4 is a perspective and sectional view, along a longitudinal plane IV-IV in FIG. 2, of the control damper shown in FIG. 2, the perspective being taken at an angle different from the angle of FIG. 2.

The adjustment device 104, shown alone in FIG. 3, comprises a support 106, a flap 108 and means 110 for adjusting the orientation of the flap 108 with respect to the support 106. In the assembled configuration of the damper 100, the adjustment device 104 is essentially received in the duct V100, and only one control member 152 of the means of adjustment 110 is located outside the duct V100.

The support 106 comprises a main portion 112 which extends along a median plane P112, and two lateral portions 114 and 116, which are situated facing each other and each extend in a plane orthogonal to the median plane P112.

When the support 106 is assembled onto the body 102, the median plane P112 is horizontal, the axis of blowing A100 is carried by the median plane P112, which is also a median plane of the damper 100, whereas the lateral portions 114 and 116 are parallel to the longitudinal plane P100.

The lateral portions 114 and 116 are configured for cooperating with slides provided in the body 102. The lateral portion 114 cooperates with a slide 118, visible in FIG. 2, whereas the lateral portion 116 cooperates with a slide 120, visible in FIG. 4. Advantageously, the lateral portion 114 comprises a shoulder 122 which cooperates with a matching stop (not shown) provided in the slide 118, so that the mounting of the support 106 is possible only in one direction, herein the direction opposite to the air flow F100. In other words, the support 106 thereby forms a slide for mounting the damper 100.

Advantageously, the body 102 comprises two flats 122, formed protruding into the duct V100 on both sides of the longitudinal plane P100 and wherein the slides 118 and 120 are formed, in such a way that the lateral portions 114 and 116 are flush with an internal surface of the duct V100, thus limiting the generation of turbulence, and hence of noise, during the operation of the damper 100 mounted in a ventilation installation 2.

The main portion 112 has a slot 113 which divides the main portion into a downstream tray 112A and an upstream tray 112B. When the damper 100 is assembled, the downstream tray 112A is situated on the downstream side 102A of the body 102 with respect to the slot 113. Herein, the slot 113 has a rectangular shape extending along the length thereof orthogonally to the lateral portions 114 and 116. The slot 113 is used for letting through the flap 108, as explained thereafter.

The flap 108 and the upstream tray 112B delimit therebetween, a pressure chamber C100 which is open in front of the air flow F100, i.e. towards the upstream side 102B. The air flow F100 thereby generates a force which tends to move the flap 108 away from the upstream tray 112B.

Figure 5:
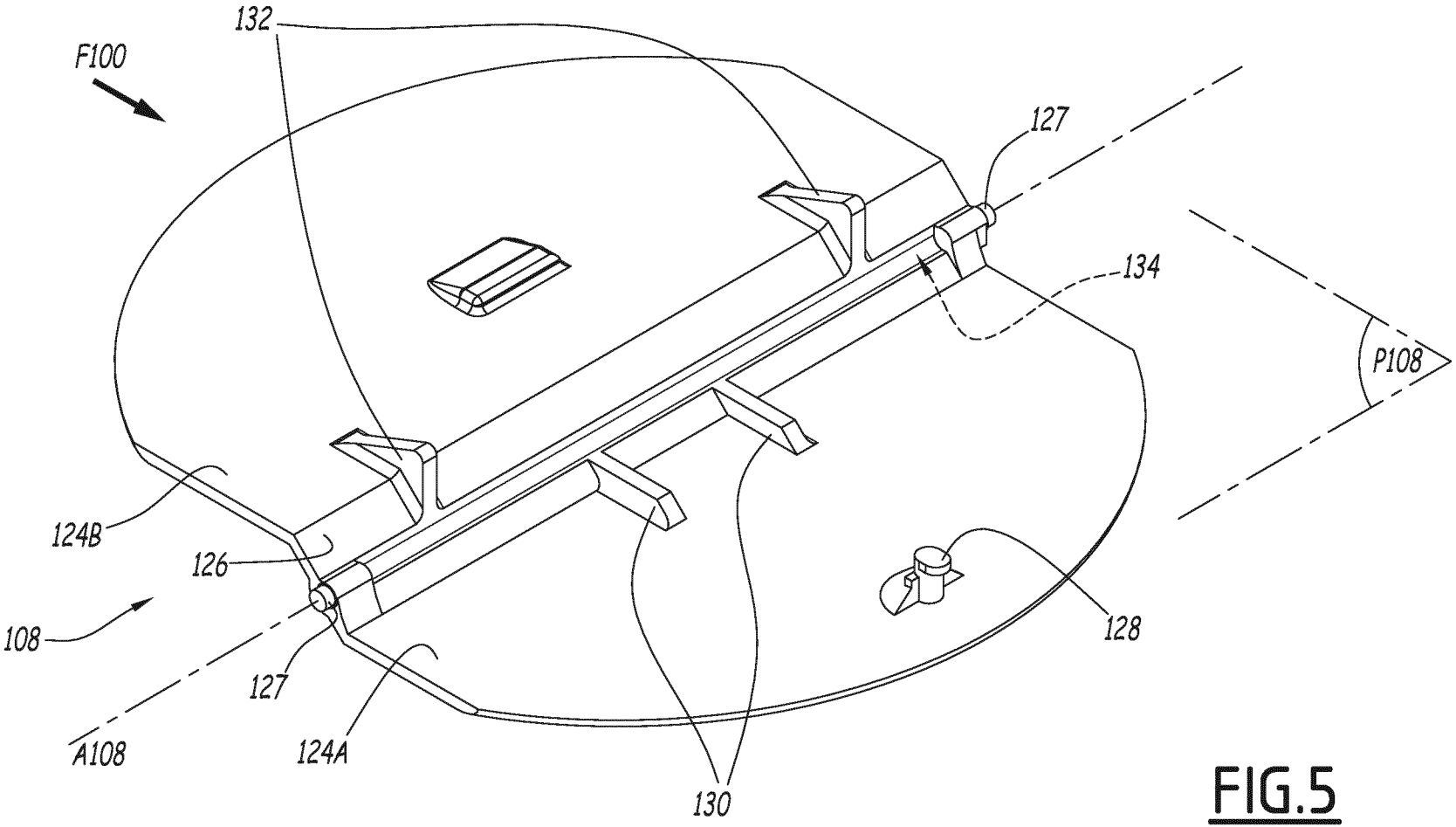
FIG. 5 is a perspective view of a flap of the control damper shown in FIG. 2.

The flap 108, shown alone in FIG. 5, herein comprises a downstream panel 124A and an upstream panel 124B, which are substantially plane and parallel to each other, and which are connected to each other by an intermediate portion 126. The intermediate portion 126 here has the shape of a rectangle, which extends along the length thereof along a pivot axis A108. At the ends thereof, the intermediate portion 126 comprises bearings 127, herein consisting of pins, which are configured for cooperating with the lateral portions 114 and 116, so that the flap 108 is movable in rotation with respect to the support 106 about the pivot axis A108.

The pivot axis A108 is thus orthogonal to the lateral portions 114 and 116. In the example, the pivot axis A108 is aligned with the slot 113, the downstream panel 124A and the upstream panel 124B being situated on both sides of the median plane P112. When the damper 100 is in the assembled configuration, the flap 108 is received in the duct V100 and is able to rotate with respect to the body 102 about the pivot axis A108, which is thus orthogonal to the axis of blowing A100.

A flap plane P108 is defined as being a plane passing through the pivot axis A108 and parallel to the downstream panel 124A.

When the flap plane P108 is not parallel to the median plane P112, the flap plane P108 and the median plane P112 are secant and define therebetween an angle of closure $\alpha$. In other words, the angle of closure $\alpha$ is the angle between the downstream panel 124A and the downstream tray 112A. Therefore, the angle of closure $\alpha$ is zero when the flap plane P108 is parallel to the median plane P112. Depending on the angle of closure $\alpha$, the duct V100 is blocked, to a variable extent, by the flap 108. Therefore, a closure of the duct V100 is determined by a position of the flap 108, which position is determined by the angle of closure$\alpha$.

When the duct V100 is blocked at a minimum, the flap 108 is in a so-called open position, wherein the angle of closure $\alpha$ is equal to a minimum angle $\alpha_{MIN}$. The air flow F100 then has a maximum flow-rate, taking into account the air pressure in the duct V100. In the example illustrated, the minimum angle $\alpha_{MIN}$ is equal to 0°, in other words, in the open position, the flap plane P108 is parallel to the median plane P112.

When the blocking of the duct V100 is maximal, the flap 108 is in a so-called closed position, wherein the angle of closure $\alpha$ is equal to a maximum angle $\alpha_{MAX}$. The air flow F100 then has a minimum flow-rate, which is a function of the air pressure in the duct V100. In the example illustrated, the maximum angle $\alpha_{MAX}$ is equal to 90°, in other words, in the closed position, the flap plane P108 is orthogonal to the median plane P112.

The flap 108 further comprises an attachment point 128 and a flange 129, which are provided on the flap 108 away from the pivot axis A108. The attachment point 128, visible in FIG. 4, consists herein in a mushroom-shaped protrusion provided on the downstream panel 124A on the side oriented towards the support 106. The attachment point 128 is used for attaching a spring 140 of the adjustment device 110, as explained thereafter. The flange 129, which is herein provided on the upstream panel 124B on the side oriented towards the support 106, is used for attaching a damper 142 of the adjustment device, as explained thereafter.

Finally, the flap 108 comprises first stops 130 and second stops 132. The first stops 130, which are herein provided on the downstream panel 124A, are configured for being pushed back by adjustment cams described thereafter, so as to prevent the flap 108 from moving between the open position and the nominal position. In other words, the nominal position of the flap 108 is defined by the cooperation of the first stops 130 and the adjustment cams.

The intermediate portion 126 comprises a bulge 134 which has the shape of a cylindrical portion of circular cross-section and centered on the flap axis A108. The bulge 134 extends along the intermediate portion 126, between the two bearings 127. When the damper 100 is assembled, the bulge 134 is arranged opposite an edge B112 of the upstream tray 112B, so as to close, within the assembly clearances, the pressure chamber C100 at the junction between the flap 108 and the upstream tray 112B regardless of the angle of closure α. Air leaks from the C100 pressure chamber are reduced, contributing to the proper operation of the damper 100. In other words, the bulge 134 cooperates with the edge B112 of the upstream tray 112B, so as to limit air leaks between the flap 108 and the upstream tray 112B.

The second stops 132, which are herein provided on the upstream panel 124B, are configured for being pushed back by control cams described thereafter, so as to prevent the movements of the flap 108 between the closed position and a control position, intermediate between the nominal position and the closed position of the flap 108. In other words, the control position of the flap 108 is defined by the cooperation of the second stops 132 and of the control cams, and corresponds to a control angle $\alpha_{REG}$.

Under the combined effect of the first stops 130 cooperating with the adjustment cams and the second stops 132 cooperating with the control cams, the movements of the flap 108 are limited between the nominal position and the control position.

The means of adjustment 110 are configured for adjusting a nominal position of the flap 108, the nominal position being intermediate between the open position and the closed position. In other words, the nominal position of the flap 108 corresponds to a nominal angle $\alpha_{NOM}$ comprised between the minimum angle $\alpha_{MIN}$ and the maximum angle $\alpha_{MAX}$.

The angular travel $\Delta\alpha$ is defined as equal to the difference between the control $\alpha_{REG}$ and the nominal angle $\alpha_{NOM}$, in other words $\Delta\alpha=\alpha_{REG}-\alpha_{NOM}$. For a given nominal position of the flap 108, the angular travel $\Delta\alpha$ thus represents the amplitude of the movement of the flap 108 between the nominal position and the corresponding control position.

It is understood that if the air pressure in the duct V100 is too low, the air flow F100 will have a too low flow-rate, even if the flap 108 is in the open position. In order to work properly, the damper 100 requires that a minimum air pressure $P_{MIN}$ is present in the duct V100. Therefore, the nominal position of the flap 108 is defined by the user as a function of the desired air flow-rate when the air pressure in the duct V100 is equal to the minimum pressure $P_{MIN}$. Otherwise, the automatic balancing nature of the controller 100 is effective for pressures below a maximum pressure $P_{MAX}$, strictly above the minimum pressure $P_{MIN}$.

Thereby, as long as the air pressure in the duct 22 is comprised between the minimum pressure $P_{MIN}$ and the maximum pressure $P_{MAX}$, the flow-rate of the air flow F100 is substantially equal to the nominal flow-rate, which is determined by the nominal position of the flap 108, in other words by the nominal angle $\alpha_{NOM}$.

In the example illustrated, the duct 22 has a diameter of 125 mm, the minimum pressure $P_{MIN}$ is equal to 50 Pa—Pascal—, the maximum pressure $P_{MAX}$ is equal to 300 Pa, whereas the damper 100 is configured for regulating a nominal flow-rate between the minimum flow-rate of 15 $m^3$/h—cubic meter-per hour—and the maximum flow-rate of 240 $m^3$/h.

The means of adjustment 110 comprise a shaft 150 and a control member, herein a graduated handwheel 152.

Figure 6:
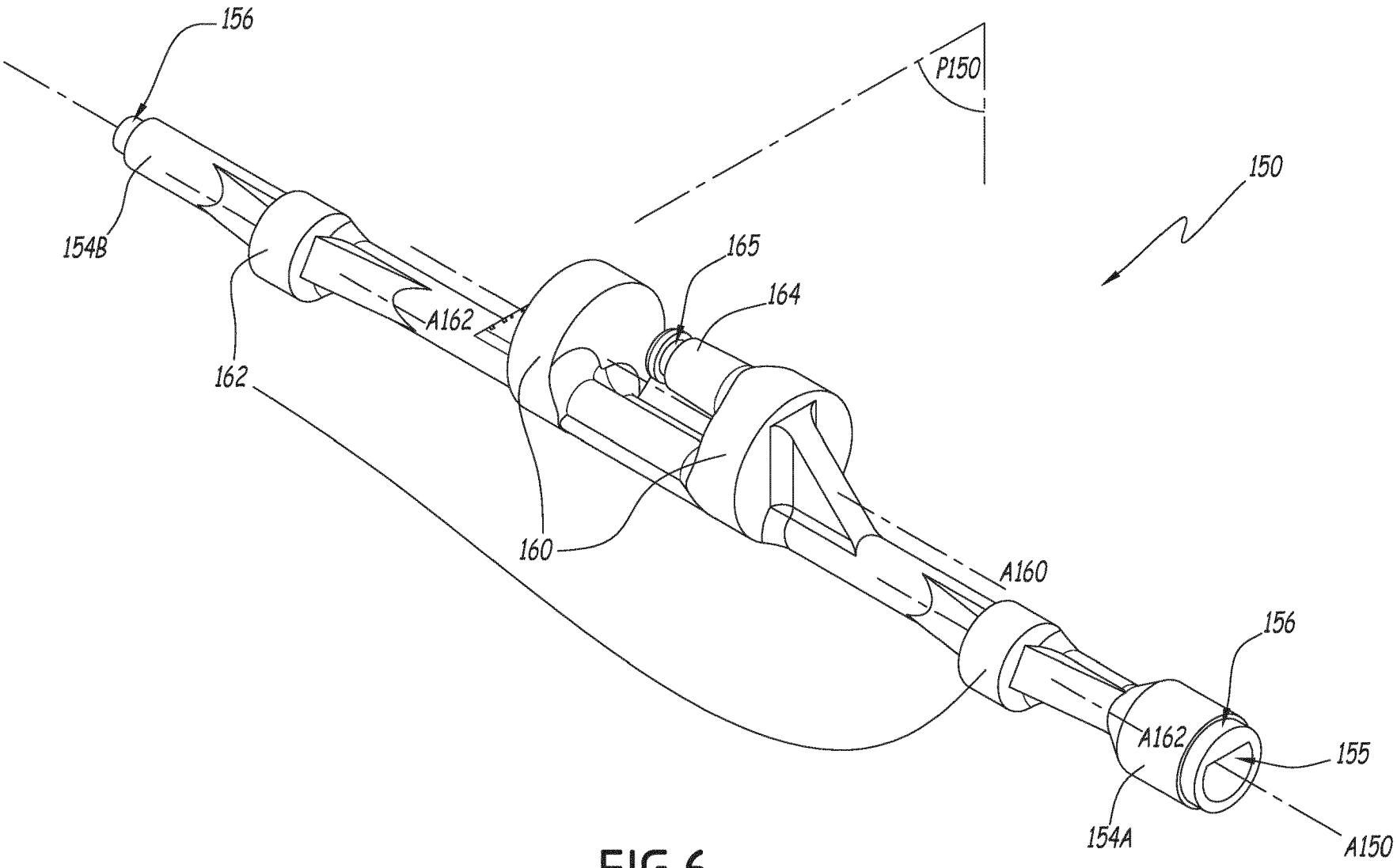
FIG. 6 is a perspective view of a shaft of the control damper shown in FIG. 2.

The shaft 150, shown alone in FIG. 6, has an elongated shape and extends along an axis of adjustment A150. The shaft 150 is preferentially made of synthetic polymer material, e.g. polyamine (PA). The shaft 150 is e.g. manufactured by hot injection, or by an additive manufacturing method, also known as 3D printing.

The shaft 150 comprises a first end 154A and a second end 154B opposite the first end 154A. The first end 154A is connected to the handwheel 152 through the body 102, so that the shaft 150 is rotated about the axis of adjustment A150 by the handwheel 152.

In the example illustrated, the first end 154A has a bulge, which provides a housing 155 of cylindrical shape extending along the axis of adjustment A150. The housing 155 advantageously has a non-circular profile configured for receiving a rod with matching shape connected to the handwheel 152. The shaft 150 is thus configured for being rotated about the axis of adjustment A150 by the handwheel 152. An angular position of the shaft 150 about the axis of adjustment 150 is set by the user by means of the control member formed by the handwheel 152. Other methods of assembling the shaft 150 and the handwheel 152 are possible, in particular by screwing or by bonding.

The first end 154A and the second end 154B each cooperate with a respective lateral portion 114 and 116, so that the shaft 150 is pivotally mounted with respect to the support 106 about the axis of adjustment A150, which is orthogonal to the lateral portions 114 and 116. For this purpose, a bearing 156 is provided on each of the first and second ends 154A and 154B, each bearing 156 being received in a matching port provided in the corresponding lateral portion 114 or 116. The matching ports are not shown.

In the assembled configuration of the adjustment device 110, the axis of adjustment A150 is parallel to the pivot axis A108 of the flap 108. The axis of adjustment A150 is distinct from the pivot axis A108, in particular for reasons of cam kinematics.

Thereby, when the damper 100 is fully assembled, the shaft 150 is movable in rotation with respect to the body 102 about the axis of adjustment A150. The angular position of the shaft 150 about the axis of adjustment A150 is set by the user by means of the control member 152. A locking member 158, herein a screw, is advantageously provided for preventing any untimely change in the angular position of the shaft 150, once the latter has been adjusted by means of the handwheel 152. The locking member 158 immobilizes the handwheel 152 in rotation about the axis A150 with respect to the body 102, and hence the shaft 150 with respect to the body 102, since the components 150 and 152 are rigidly attached in rotation about the axis A150. The locking member 158 is also used for retaining the support 106 inside the body 102.

The shaft 150 also comprises two adjustment cams 160. The adjustment cams 160 have the same profile and protrude on the shaft 150, radially to the axis A150. Each adjustment cam 160 has a cylindrical shape with an axis A160, which is parallel to and distinct from the axis of adjustment A150. The axes A160 of the two cams 160 are aligned therebetween.

In a non-limiting way, the adjustment cams 160 have herein a circular profile, which is not centered on the axis of adjustment A150. In a variant (not shown), the adjustment cams 160 have an elliptical or else an ovoid profile.

Each adjustment cam 160 is configured for cooperating with one of the respective first stops 130 of the flap 108, so as to prevent movements of the flap 108 between the open position thereof and the nominal position thereof.

When the shaft 150 rotates about the axis of adjustment A150, under the action of a user who adjusts the nominal flow-rate, the adjustment cams 160 push back the first stops 130. When the first stops 130 are in contact with the adjustment cams 160, the flap 108 is in its nominal position, the nominal angle $\alpha_{NOM}$ depending on the angular position of the shaft 150 about the axis of adjustment A150.

The two adjustment cams 160 are advantageously provided symmetrically on both sides of a transverse plane P150 of the shaft 150, the transverse plane 150 being orthogonal to the axis of adjustment A150 and situated halfway between the ends 154A. When the damper 100 is fully assembled, the transverse plane P150 coincides with the longitudinal plane P100 of the damper 100. Thereby, the forces of the adjustment cams 160 on the flap 108, result in a moment, with respect to the pivot axis A108, carried by the longitudinal plane P100, which reduces the risks of deformation of the flap 108, and hence reduces the risks of malfunction.

Conventionally, in the controllers disclosed in the prior art, when the air pressure increases, the movement of the flap 108 is only brought back to the nominal position thereof, by a return device. However, if the flap 108 gets too close to the closed position, the air flow may fall considerably below the nominal flow expected by the user. In other words, the controller 100 "chokes" and no longer fulfills the function thereof.

Advantageously, the shaft 150 also comprises two control cams 162. The two control cams 162 have the same profile and protrude radially from the shaft 150. Each control cam has a cylindrical shape with an axis A162, which is parallel and distinct from the axis of adjustment A150. The axes A162 of the two adjustment cams 162 are aligned therebetween. In a non-limiting manner, the control cams 162 herein have a circular profile, which is not centered on the axis of adjustment A150. In a variant (not shown), the control cams 162 have an elliptical profile or else an ovoid profile.

Each control cam 162 is configured for correspondingly cooperating with one of the second stops 132 provided on the flap 108, so as to prevent movements of the flap 108 between the closed position thereof and the control position thereof. The shape and arrangement of the control cams 162 and of the stops 132 are chosen by the manufacturer of the damper 100 so as to prevent the choking effect of the damper 100.

The control cams 162 are radially offset, with reference to the axis of adjustment A150, with respect to the adjustment cams 160. In other words, the axis A160 of the adjustment cams 160 and the axis A162 of the control cams 162 are not located in the same radial plane as the axis of adjustment A150, so that the angular displacement $\Delta\alpha$ is not zero.

The shaft 150 further comprises a hard point 164, herein consisting of a pin having a groove 165. The hard point 164, which is herein provided between the two adjustment cams 160, is configured for cooperating with a first end of the spring 140. When the damper 100 is fully assembled, a second end of the spring 140 is attached to the attachment point 128 provided on the flap 108, so that the spring 140 is tensioned regardless of the position of the flap 108, i.e. including when the flap 108 is in the nominal position. The spring 140, which is herein a helical tension spring made of metal, preferentially of stainless steel, is an example of an embodiment of a return device, configured for returning the flap 108 to the nominal position when, under the effect of the air flow F100, the flap 108 is moved away from the nominal position thereof.

Advantageously, the hard point 164 is offset with respect to the axis of adjustment A150, so that a distance between the hard point 164 and the attachment point 128 is variable when the angular position of the shaft 150 changes, under the action of a user who adjusts the nominal position of the flap 108, in other words, who sets the nominal angle $\alpha_{NOM}$. The spring 140 is herein a tension spring. A length L140 of the spring 140 is equal to the distance between the hard point 164 and the attachment point 128.

Figure 7:
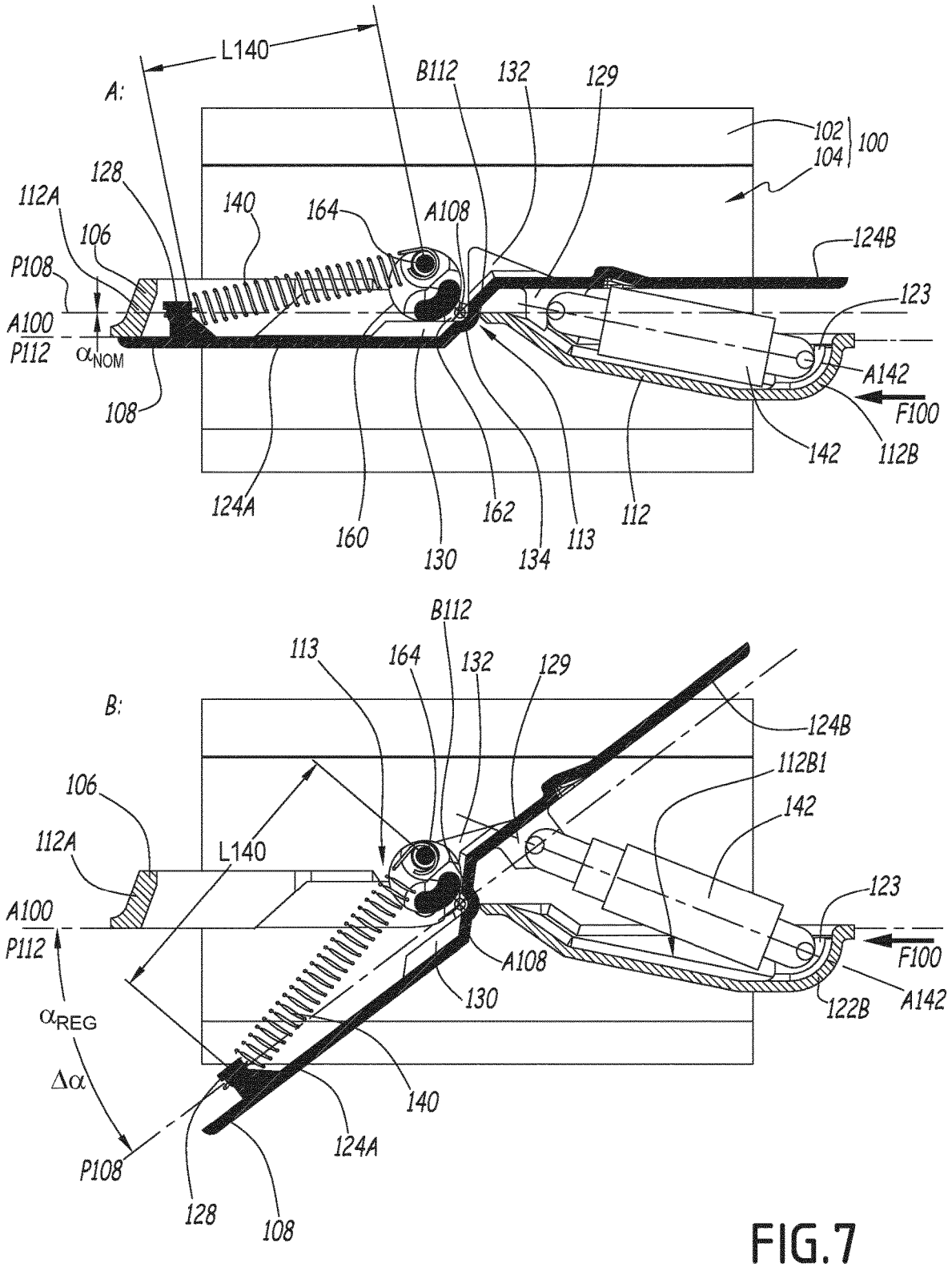
FIG. 7 shows a section along the longitudinal plane IV-IV, on two inserts A) and B), of the control damper shown in FIG. 2, in a first nominal configuration and in a first control configuration, respectively.
Figure 8:
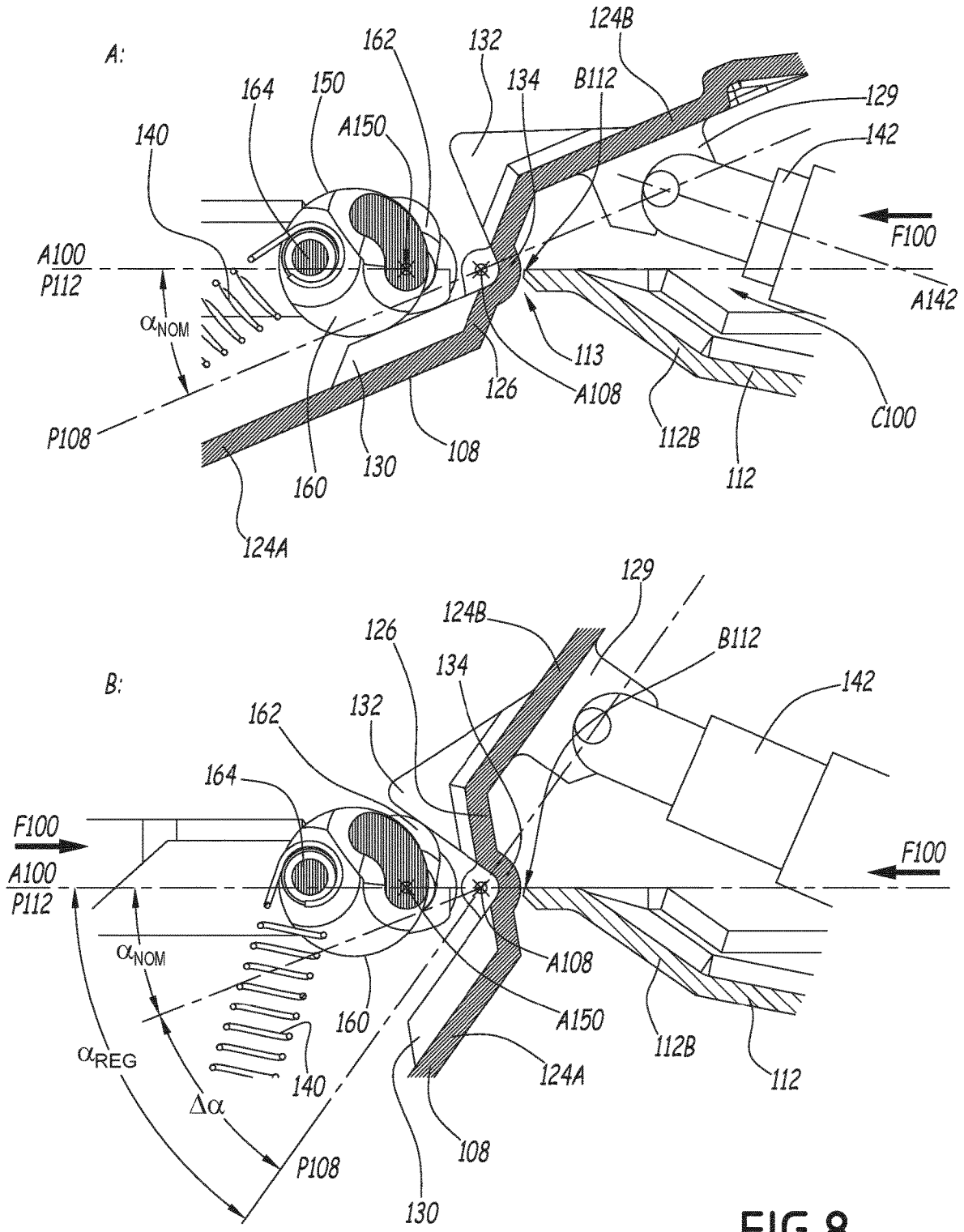
FIG. 8 is a view similar to FIG. 7, partially representing, on a larger scale, in two inserts A) and B), the control damper shown in FIG. 2, in a second nominal configuration and a second control configuration, respectively.
Figure 9:
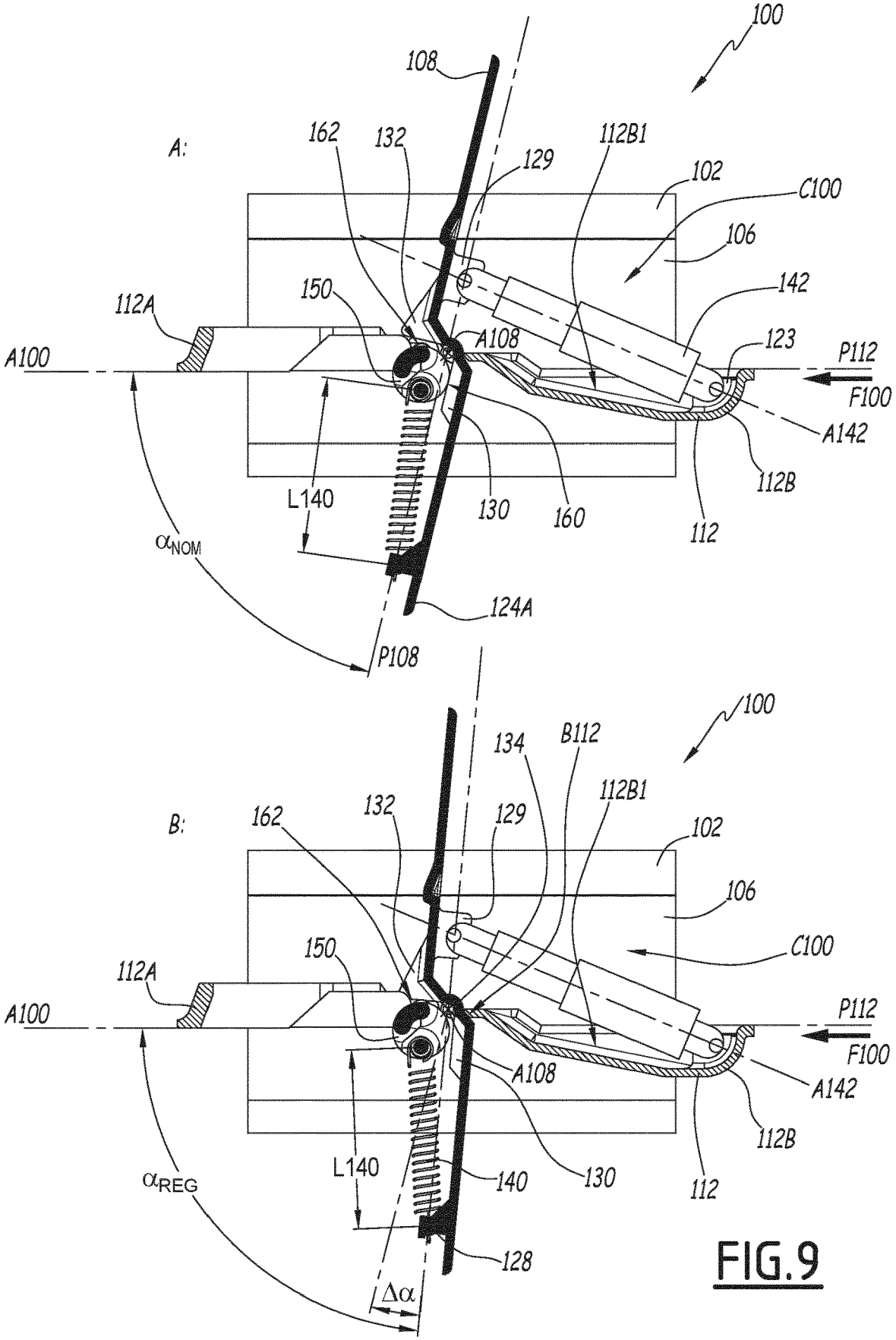
FIG. 9 is a view similar to FIG. 7, representing, in two inserts A) and B), the control damper shown in FIG. 2, in a third nominal configuration and a third control configuration. respectively.

As the nominal angle $\alpha_{NOM}$ increases, the length L140 decreases, so that the return force of the spring 140 decreases. Such effect is illustrated in FIGS. 7 to 9, described hereinafter.

As a result, the return force of the spring 140 is all the lower as the flow-rate chosen by the user is reduced, which means that the damper 100 is more sensitive to low flow-rates, the flow-rate of the air flow F100 being more stable over a wide pressure range. A stiffness of the spring 140 is determined experimentally as a function of the dimensioning of the damper 100.

When the damper 100 is assembled, the hard point 164 and the attachment point 128 are advantageously carried by the longitudinal plane P100 of the damper, so as to prevent the deformations of the flap 108 under the effect of the return force of the spring 140. When the flap 108 is in the nominal position, each first stop 130 abuts onto a respective adjustment cam 160, and the spring 140 exerts the return force thereof between the points of contact of each first stop 130 with the respective adjustment cam 160.

Since the air flow phenomena are not linear, the higher the nominal flow-rate set by the user, the greater the amplitude of the movement of the flap 108 for the flow-rate control to be effective over the entire pressure range. In other words, when the nominal angle $\alpha_{NOM}$ is close to $\alpha_{MIN}$, i.e. when the user wants a high air flow-rate, the angular travel $\Delta\alpha$ needed for regulating the air flow F100 at the required level between the minimum pressure $P_{MIN}$ and the maximum pressure $P_{MAX}$ is greater than the angular travel $\Delta\alpha$ needed when the nominal angle $\alpha_{NOM}$ is close to $\alpha_{MAX}$, i.e. when the user desires a reduced air flow.

Advantageously, the radial offset between the axes A160 and A162 of the adjustment 160 and control 162 cams, as well as the respective profiles of the adjustment 160 and control 162 cams, are chosen in such a way that as the nominal angle $\alpha_{NOM}$ increases, the angular travel $\Delta\alpha$ decreases. Such effect is illustrated in FIGS. 7 to 9, described hereinafter.

The flap 108 tends to move away from the nominal position under the effect of the pressure of the air flow F100 and to be returned to the nominal position thereof under the effect of the spring 140. Since the air pressure in the V100 duct is never perfectly stable, the flap 108 may exhibit a movement of oscillation, which could generate noise and be detrimental to the stability of the flow-rate of the F100 air flow. Advantageously, the control damper 100 thus comprises a damping member 142 configured for damping the movements of the flap 108 when the flap 108 moves, under the effect of variations in the air flow F100 and of the return device, between the nominal position thereof and the control position thereof.

In the example illustrated, the damping member 142 has an elongated cylindrical shape along an axis of damping A142 and comprises two opposite ends, aligned along the axis of damping A142 and connected to the flange 129 of the flap 108 and to an anchoring point 123, respectively, provided on the support 106. In the example, the flange 129 is provided on the upstream panel 124B of the flap 108, while the anchoring point 123 is provided on the upstream tray 112B of the support 106.

When a distance between the flange 129 and the anchoring point 123 changes, the damping member 142 generates a damping force which opposes such change and which is aligned with the axis of damping A142.

The damping member 142 is preferentially a gas spring, which has a sufficiently low inertia to damp the movements of oscillation of the flap 108.

Advantageously, the flange 129 and the anchoring point 123 are arranged in such a way that the moment of the damping force with respect to the pivot axis A108 is not zero, irrespective of the position of the flap 108. Thereby, the damping member 142 is effective even when the flap 108 is in the open position and the flow-rate of the air flow is maximum.

In the example, the flange 129 is carried by the flap plane P108, whereas the anchoring point 123 is provided in a recess 112B1 of the upstream tray 112B, so that the axis of damping A142 does not intersect the pivot axis A108 of the flap 108, irrespective of the position of the flap 108.

In each of FIGS. 7, 8 and 9, the control damper 100 is represented in three different configurations, respectively, each corresponding to an angular position of the shaft 150, adjusted by the user. In other words, a different nominal angle $\alpha_{NOM}$ corresponds to each of the FIGS. 7 to 9.

In the insert A) in each of the FIGS. 7, 8 and 9, the flap 108 is in the nominal position thereof. The first stops 130 of the flap 108 are in contact with the adjustment cams 160, in other words the angle of closure $\alpha$ is equal to the nominal angle $\alpha_{NOM}$.

In the insert B) of each of the FIGS. 7 to 9, the flap 108 is in the control position thereof. The second stops 132 of the flap 108 are in contact with the control cams 162, in other words the angle of closure$\alpha$ is equal to the control angle $\alpha_{REG}$.

In FIG. 7, the nominal angle $\alpha_{NOM}$ is equal to the minimum angle $\alpha_{MIN}$, i.e. 0° herein. On the insert A), the flap plane P108 is parallel to the median plane P112. The flap 108 is in the open position, and the air flow F100 has a maximum flow-rate.

From the nominal position thereof, if the air pressure in the duct V100 increases, the flap 108 is moved away from the nominal position thereof until reaching the control position thereof, shown in the insert B).

In the example illustrated, the control angle $\alpha_{REG}$ is equal to approximately 40°. The angular amplitude $\Delta\alpha$ herein is equal to about 40°. In other words, for a nominal angle $\alpha_{NOM}$ equal to 0°, the angular travel $\Delta\alpha$ is substantially equal to 40°.

In FIG. 8, the angular position of the shaft 150 corresponds to a nominal angle $\alpha_{NOM}$ of the flap 108 of about 25°. On the insert B), the flap 108 is in the control position thereof, and the control angle $\alpha_{REG}$ is substantially equal to 50°. In other words, fora nominal angle $\alpha_{NOM}$ of about 25°, the angular travel $\Delta\alpha$ is substantially equal to 25°.

In FIG. 9, the angular position of the shaft 150 corresponds to a nominal angle $\alpha_{NOM}$ of about 80°. On the insert B), the flap 108 is in the control position thereof, and the control angle $\alpha_{REG}$ is substantially equal to 85°. In other words, for a nominal angle $\alpha_{NOM}$ substantially equal to 80°, the angular travel $\Delta\alpha$ is substantially equal to 5°.

The three FIGS. 7, 8 and 9 thereby illustrate one of the advantages of the invention, according to which the angular travel $\Delta\alpha$ decreases as the nominal angle $\alpha_{NOM}$ increases.

Between the insert A) of FIG. 7 and the insert A) of FIG. 9, the shaft 150 rotates by approximately 180° about the axis of adjustment A150, whereas the nominal angle $\alpha_{NOM}$ changes from 0° to approximately 85°. During such movement, the hard point 164 approaches the attachment point 128, in other words the length L140 decreases.

The inserts A) of the three FIGS. 7, 8 and 9 thereby illustrate another of the advantages of the invention, according to which the return force of the return device 140 decreases as the nominal angle $\alpha_{NOM}$ increases.

In addition, in each of FIGS. 7, 8 and 9, when the flap 108 changes from the nominal position thereof, illustrated on the insert A), to the control position thereof, illustrated on the insert B), the length L140 of the spring 140 increases, in other words the return force of the spring 140 increases, and the flap plane P108 moves away from the hard point 164, in other words the moment of said return force with respect to the pivot axis A08 increases. The two effects add together, which contributes to improving the control capacity of the damper 100 when the air pressure increases in the duct 22.

During the assembly of the damper 100, the flap 108 and the shaft 150 are each assembled onto the support 106 which is received in the duct V100 and attached to the body 102. The angular position of the shaft 150 is controlled from outside the body 102 by means of the control member formed by the handwheel 152. The assembly of the damper 100 is particularly simple to carry out.

The angle of closure $\alpha$ and the nominal flow-rate of the flow F100 are not related to each other by a linear relationship, in the same way as the angular position of the shaft 150 about the axis of adjustment A150 and the nominal flow-rate of the flow F100 are not linked to each other by a linear relationship. The handwheel 152 advantageously comprises graduations 152A, so that the user knows, from outside the body 102, the angle of closure $\alpha$ and/or the corresponding flow-rate.

In the example illustrated, the angular position of the shaft 150 is defined manually by the user who adjusts the angular position of the shaft 150 by means of the handwheel 152 immobilized by the screw 158.

In a variant (not shown), the handwheel 152 and the screw 158 are replaced by a motorized device, e.g. connected to a programmer or to a home automation system.

In the example illustrated, the shaft 150 comprises two adjustment cams 160, each of which cooperates with a respective first stop 130. In a variant (not shown), the shaft comprises only one adjustment cam 160 or more than two adjustment cams.

In the example illustrated, the shaft 150 comprises two control cams 162, each of which cooperates with a respective second stop 132. In a variant (not shown), the shaft comprises only one control cam 162 or more than two control cams.

In the example illustrated, the adjustment cams 160 and the control cams 162 are separate cams, each of which has a circular profile. In a variant (not shown), each control cam 162 is associated with a respective adjustment cam 160, each control cam 162 and the associated adjustment cam 160 being respective portions of the same radial protrusion provided on the shaft 150.

In the example illustrated, the return device 140 is situated on the downstream side 102A, and the damping member 142 is located on the upstream side 102B, which allows for an easy assembly and uses simple and inexpensive components—spring and damper—. In a variant (not shown), the respective positions of the return device 140 and of the damping member 142 are permuted, or even the return and damping devices are situated on the same side, downstream or upstream, or even are integrated into the same return and damping device.

The aforementioned embodiments and variants can be combined so as to generate new embodiments of the invention.

The invention claimed is:

1. A control damper for regulating air flow for a ventilation duct, the control damper comprising:

a cylindrical body extending along an axis of blowing, defining an air duct configured to guide the air flow along the axis of blowing;

an adjustment device comprising:

a flap for blocking the air duct, the flap being received in the air duct and being movable in rotation with respect to said body about a pivot axis orthogonal to the axis of blowing, between an open position, wherein the air duct is minimally closed, and a closed position, wherein the blockage of the air duct is maximum; and means of adjustment configured for adjusting a nominal position of said flap, the nominal position being intermediate between the open position and the closed position, said flap in the nominal position defining, along with a median plane of the damper, a nominal angle, the median plane being parallel to the axis of blowing and to the pivot axis, the means of adjustment comprising:

a shaft, extending along an axis of adjustment and pivotally mounted with respect to said body about the axis of adjustment, the axis of adjustment being parallel to the pivot axis, an angular position of the shaft about the axis of adjustment being adjustable; and at least one adjustment cam, each adjustment cam protruding radially from said shaft and cooperating with a respective first stop of said flap, so as to limit movement of said flap between the nominal position thereof and the open position thereof when the user defines the angular position of said shaft; and a return device, configured for returning said flap to the nominal position thereof when said flap is moved away from the nominal position by air flow through the air duct, the return device comprising a tension spring with a first end and an opposite second end, wherein the first end is connected to a hard point provided on said shaft, and wherein the second end is connected to an attachment point provided on said flap, so that the tension spring is tensioned when said flap is in the nominal position.

2. The control damper according to claim 1, wherein the hard point is offset from the axis of adjustment such that as the nominal angle increases, the length of said tension spring, and hence the moment of return of said flap towards its nominal position with respect to the pivot axis, decrease.

3. The control damper according to claim 1, wherein the hard point and the attachment point lie in a longitudinal plane of said body, the longitudinal plane being orthogonal to the pivot axis and containing the axis of blowing.

4. The control damper according to claim 3, wherein said at least one adjustment cam comprises at least two adjustment cams, which are provided symmetrically on both sides of the longitudinal plane.

5. The control damper according to claim 1, wherein said adjustment device comprises a slide, wherein said flap and said shaft are each connected to the slide and are movable in rotation with respect to the slide, the slide being received in the air duct and attached to said body, the angular position of said shaft being controlled from outside the air duct by a control member.

6. The control damper according to claim 5, further comprising a damping member damping movement of said flap as said flap moves between the nominal position thereof and a control position thereof under the effect of the variations of air flow through the air duct and of said return device.

7. The control damper according to claim 6, wherein:

said damping member has two opposite ends which are connected to a flange of said flap and to an anchoring point, respectively, of said slide and which are aligned along an axis of damping, said damping member generating a damping force along the axis of damping, and the anchoring point is provided in a recess of said slide, so that the axis of damping does not intersect the pivot axis of said flap, irrespective of the position of said flap.

8. The control damper according to claim 6, wherein said damper member is a gas spring.

9. The control damper according to claim 1, wherein said shaft further comprises at least one control cam, which is distinct from said at least one adjustment cam, each control cam radially protruding from said shaft, and wherein said flap comprises at least one second stop, each second stop cooperating with a respective control cam so as to prevent movement of said flap between the closed position and a control position, the control position being an intermediate position between the nominal position and the closed position of said flap.

10. A ventilation installation, comprising:

a drive unit;

a ventilation duct guiding air flow displaced by said drive unit; and a control damper according to claim 1 installed in said ventilation duct regulating the flow-rate of air flow through said ventilation duct.

11. The control damper according to claim 5 wherein the control member is a handwheel.

* * * * *